US006477720B2

(12) United States Patent
Tomita et al.

(10) Patent No.: US 6,477,720 B2
(45) Date of Patent: Nov. 12, 2002

(54) SANITARY WASHING DEVICE HAVING AUTOMATIC NOZZLE PIPE WASHER

(75) Inventors: Tadashi Tomita; Yoshifumi Makino, both of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/805,245

(22) Filed: Mar. 14, 2001

(65) Prior Publication Data

US 2001/0022006 A1 Sep. 20, 2001

(30) Foreign Application Priority Data

Mar. 14, 2000 (JP) ..... 2000-070110

(51) Int. Cl.[7] ..... A47K 3/26
(52) U.S. Cl. ..... 4/420.4; 4/447
(58) Field of Search ..... 4/420.4, 420.1, 4/420.2, 447

(56) References Cited

U.S. PATENT DOCUMENTS 4,581,779 A * 4/1986 Matsui et al. ..... 4/420.4 X
4,933,997 A * 6/1990 Kaneko ..... 4/420.4

FOREIGN PATENT DOCUMENTS

JP 5-239856 9/1993
JP 11158976 * 6/1999 ..... 4/420.4

* cited by examiner

*Primary Examiner*—Timothy L. Maust
*Assistant Examiner*—Kathleen J. Prunner
(74) *Attorney, Agent, or Firm*—Oblon, Spivak, McClelland, Maier & Neustadt, P.C.

(57) ABSTRACT

A sanitary washing device cleans a nozzle pipe thereof automatically. The sanitary washing device includes a changeover valve supplying a warm water to a nozzle pipe, a nozzle pipe selectively accommodated in a cylinder, and an ejecting outlet provided on the end portion of the nozzle pipe to spray warm water in order to wash a portion of the user sitting on a toilet bowl. The nozzle pipe is retracted in order to be accommodated in the cylinder again when the warm water supply through the changeover valve is stopped. A nozzle pipe washer is positioned to spray washing water onto the nozzle pipe. By controlling the changeover valve, a nozzle pipe washer ejecting outlet sprays the warm water onto the nozzle pipe in accordance with the movement of the nozzle pipe.

18 Claims, 4 Drawing Sheets

SANITARY WASHING DEVICE HAVING AUTOMATIC NOZZLE PIPE WASHER

CROSS REFERENCE TO RELATED APPLICATIONS

The present application is based on Japanese Application 2000-070110, filed on Mar. 14, 2000, which is hereby incorporated by reference in its entirety.

BACKGROUND OF THE INVENTION

1. Field of the Invention

This invention relates to a sanitary washing device which washes a portion of a user by water sprayed from a nozzle pipe.

2. Description of the Background

As shown in FIG. 5, a conventional sanitary washing device 100, as disclosed in Japanese Patent Application Publication published as Toku-Kai-Hei 5-239856, is provided with a shower unit 101 comprising a changeover valve 102 and a pair of cylinders 103. The changeover valve 102 is a controlling valve supplying washing water to any of the pair of cylinders 103. A pair of cylindrical nozzle pipes 104 are accommodated in the pair of cylinders 103 and are caused to extend outward or retract into the cylinders 103 by the pressure of the washing water supplied through the changeover valve 102.

According to this mechanism, after the nozzle pipe 104 is extended forward from the cylinder 103 by the force of the washing water, the washing water is sprayed from an ejecting outlet of the nozzle pipe 104 toward a portion of a user sitting on a toilet bowl, for washing the a portion of the user. When the washing water supplied through the changeover valve 102 is stopped, the nozzle pipe 104 is retracted and is accommodated in the cylinder 103. Therefore, when the user uses the lavatory, the user's excrement is not spattered directly on the nozzle pipes 104 since the nozzle pipes 104 are accommodated in the cylinders 103.

However, the nozzle pipes 104 may still become dirty when the portion of the user is washed by the washing water sprayed from the ejecting outlet of the nozzle pipes 104, as the human excrement attached to the portion of the user may be spattered or the washing water may drip from the portion of the user.

Accordingly, the sanitary washing device 100 as shown in FIG. 5 is provided with a knob 105 in order to manually pull out a nozzle pipe 104 retracted in the cylinder 103. The user can then clean the nozzle pipe 104, since the nozzle pipe 104 is extended from the cylinder 103 without washing water being sprayed from the ejecting outlet of the nozzle pipe 104. However, this is unpleasant and, since the user cannot normally see the nozzle pipe 104 in the toilet bowl, cleaning of the nozzle pipe 104 is still difficult.

SUMMARY OF THE INVENTION

Accordingly, it is an object of the present invention to provide a sanitary washing device with an automatic: nozzle pipe cleaning apparatus.

According to a feature of the invention, the above and other objects are addressed by a sanitary washing device comprising a nozzle pipe accommodated in a cylinder so as to be selectively extended from the cylinder in order to spray washing water from an ejecting outlet of the nozzle pipe; a nozzle pipe washer positioned to spray washing water onto the nozzle pipe; and a control device configured and adapted to cause the nozzle pipe washer to spray washing water onto; the nozzle pipe in accordance with a movement of the nozzle pipe.

According to another feature of the invention, the above and other objects are addressed by a sanitary washing device in a toilet bowl for washing a portion of a user sitting on the toilet bowl, comprising a cylinder; at least one nozzle pipe accommodated in the cylinder so as to be selectively extended from the cylinder in order to spray washing water from an ejecting outlet of the nozzle pipe onto the portion of a user sitting on the toilet bowl; a nozzle pipe washer positioned to spray washing water onto the at least one nozzle pipe; and a control device configured and adapted to cause the nozzle pipe washer to spray washing water onto the at least one nozzle pipe in accordance with a movement of the at least one nozzle pipe.

According to yet another feature of the invention, the above and other objects are addressed by a sanitary washing device in a toilet bowl for washing a portion of a user sitting on the toilet bowl, comprising nozzle pipe means selectively extendable from a cylinder for spraying washing water from an ejecting outlet of the nozzle pipe means onto the portion of a user sitting on the toilet bowl; nozzle pipe washer means positioned to spray washing water onto the nozzle pipe means, and control means for causing the nozzle pipe washer means to spray washing water onto the nozzle pipe means in accordance with a movement of the nozzle pipe means.

In the sanitary washing device according to the invention, after the retracted nozzle pipe is moved forward and extended outward, the washing water for the portion of the user is sprayed from the ejecting outlet of the nozzle pipe for washing the portion of the user sitting on the toilet bowl and the nozzle pipe is retracted for being accommodated in the cylinder again. At this time, the nozzle pipe washer sprays the washing water to the device for cleaning thereof in accordance with the movement of the nozzle pipe.

Any driving power source can be used for moving the nozzle pipe. For instance, a type using the pressure of the washing water, or a type using a motor, can be used.

In the sanitary washing device of the invention, when the washing water outputted from the ejecting outlet of the nozzle pipe washes the portion of the user, human excrement attached to the portion of the user is spattered or warm water is dripped from the portion of the user. However, the nozzle pipe will be cleaned automatically since the nozzle pipe washer sprays washing water to the nozzle pipe in accordance with the movement of the nozzle pipe.

If the nozzle pipe washer sprays washing water onto the nozzle pipe while the nozzle pipe is retracting, and after the event making the nozzle pipe dirty, such as the human excrement attached to the portion of the user being spattered or the warm water being dripped from the portion of the user, has occurred, at least a minimal cleaning of the nozzle pipe can be assured with only a small use of washing water.

In addition, if the nozzle pipe washer sprays washing water onto the nozzle pipe while the nozzle pipe is extending, and before the event making the nozzle pipe dirty, such as the human excrement attached to the portion of the user being spattered or the warm water being dripped from the portion of the user, has occurred, the nozzle pipe is not easily made dirty since it has been wetted by the washing water.

In addition, if the nozzle pipe washer sprays washing water onto the nozzle pipe from a time when the nozzle pipe starts extending from the cylinder until a time when the nozzle pipe is retracted and is again accommodated in the cylinder, that is, both before and after the event making the body of the nozzle pipe dirty, such as the human excrement attached to the portion of the user being spattered or the warm water being dripped from the portion, of the user, has occurred, the nozzle pipe washer continuously sprays washing water onto the nozzle pipe.

When the washing water for the portion of the user, and the washing water for the nozzle are supplied by a warm tank through a changeover valve, since an existing washing water for the portion of the user system can be used to carry out the preferred embodiment of the sanitary washing device, the structure of an existing sanitary washing device need not to be redesigned to a large degree.

The nozzle pipe of the preferred sanitary washing device is extended and retracted by the warm water. A knob may also be mounted on the end of the nozzle pipe so that the nozzle pipe can also be manually extended for manual cleaning. However, since the nozzle pipe is cleaned automatically in the manner described above, such manual cleaning, which is likely to be unpleasant, need be done only rarely.

BRIEF DESCRIPTION OF THE DRAWINGS

A more complete appreciation of the invention and other advantages thereof will be readily obtained as the same becomes better understood by reference to the following detailed description when considered in connection with the accompanying drawings, wherein.

Figure 1:
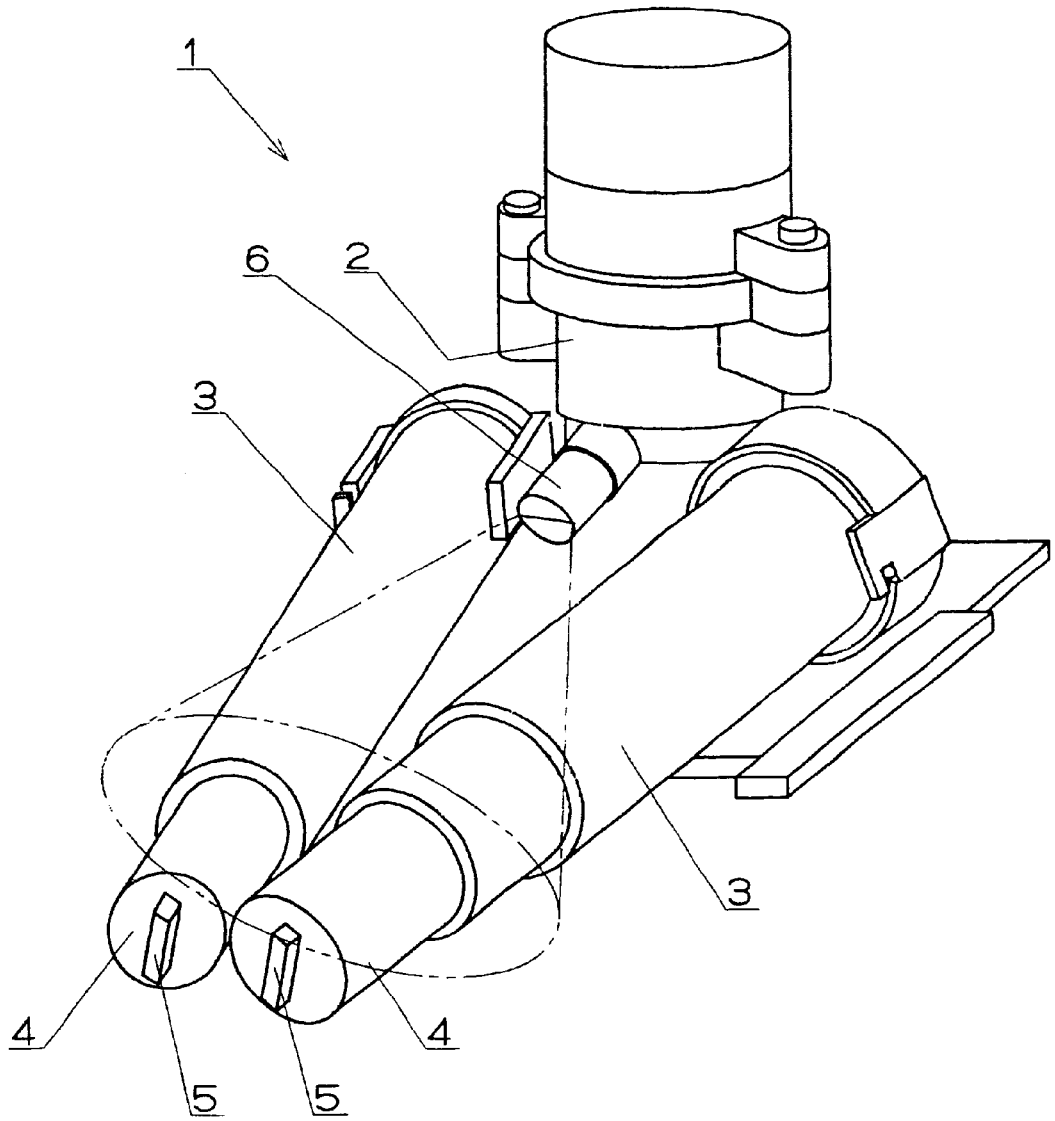
FIG. 1 shows a perspective view of a shower unit of a sanitary washing device of the present invention.
Figure 5:
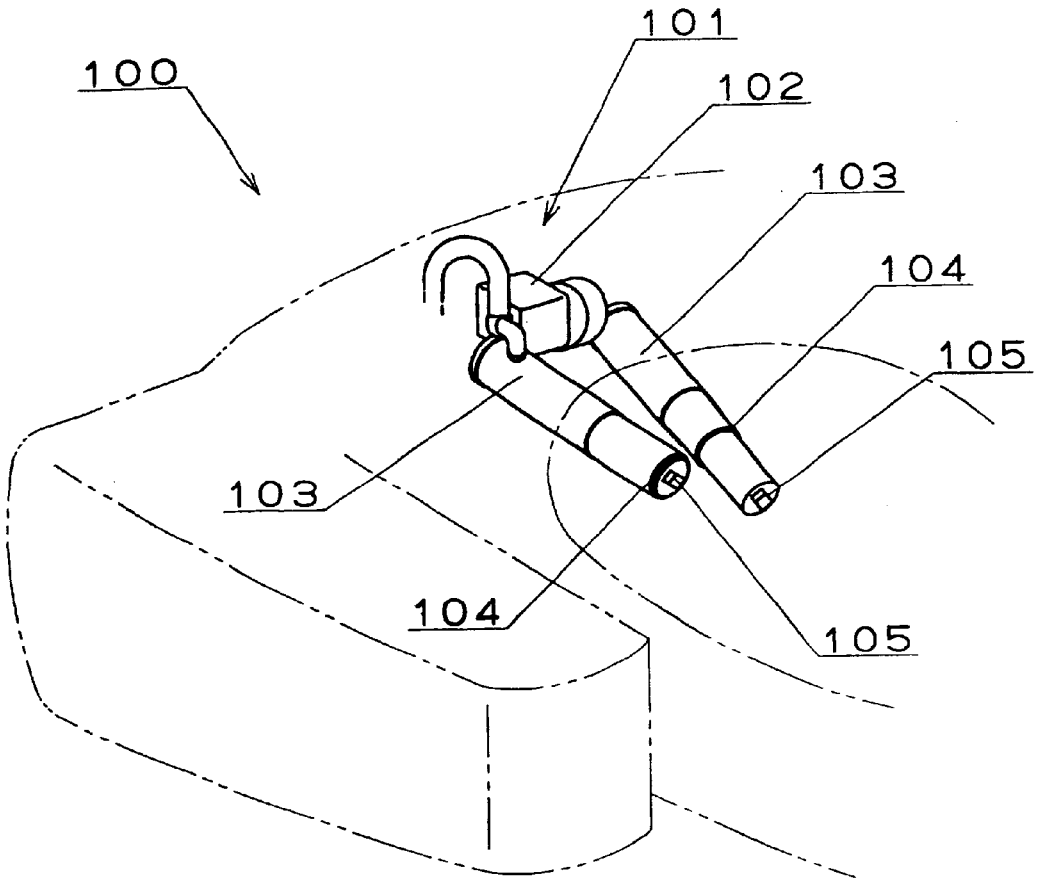
PRIOR ART Fig. 5
FIG. 5 shows a conventional sanitary washing device.

Referring now to the embodiment of a sanitary washing device of the present invention shown in the attached drawings, a sanitary washing device is provided with a shower unit 1 shown in FIG. 1, which is positioned in a toilet bowl in the same way as the device of FIG. 5. The shower unit 1 is comprised of changeover valve 2, a pair of cylinders 3 and a nozzle pipe washer 6 (nozzle pipe washer means) having an ejecting outlet.

DETAILED DESCRIPTION OF A PREFERRED EMBODIMENT

Referring now to the embodiment of a sanitary washing device of the present invention shown in the attached drawings, a sanitary washing device is provided with a shower unit 1 shown in FIG. 1, which is positioned in a toilet bowl in the same way as the device of FIG. 5. The shower unit 1 is comprised of changeover valve 2, a pair of cylinders 3 and for a nozzle pipe washer 6 (nozzle pipe washer means) having an ejecting outlet.

The changeover valve 2 is a control valve (control means) which may be comprised of a plurality of solenoid valves alternatively supplying warm water from a warm water tank 7 to either the pair of cylinders 3, or to the ejecting outlet for the nozzle pipe washer 6. Accordingly, the warm water from the warm water tank 7 may be supplied as washing water for a portion of the user, or as washing water to wash a pair of nozzle pipes 4.

The pair of cylinders 3 accommodate a cylindrical pair of nozzle pipes 4 which may be extended and retracted by the warm water supplied through the changeover valve 2. Accordingly, in the cylinder 3 supplied with warm water through the changeover valve 2, after the nozzle pipe 4 is extended from the cylinder 3 by the force of the warm water, the warm water is sprayed from an ejecting outlet provided on the end portion of the nozzle pipe 4, to the portion of the user sitting on the toilet bowl. When the supply of warm water through the changeover valve is stopped, the nozzle pipe 4 is retracted and is accommodated in the cylinder 3. The mechanism for extending and retracting the nozzle pipe 4 by the warm water may be the conventional mechanism disclosed, for instance, in Japanese Patent Publication published as Toku-Kai-Hei 5-239856, which is hereby incorporated by reference.

The nozzle pipe 4 accommodated in one cylinder 3 is exclusively used for anus washing, whereas the other nozzle pipe 4 accommodated in the other cylinder 3 is exclusively used for a bidet or female's pubic portion washing. Accordingly, although no distinction is made between the two nozzle pipes 4 for explanation purposes herein, they are controlled differently by the actual operation of the changeover valve 2.

Figure 2:
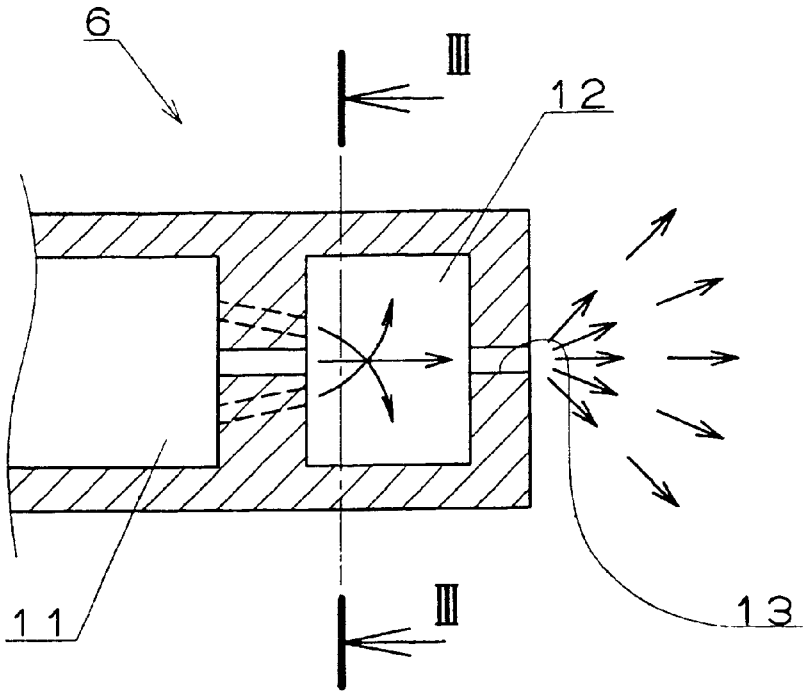
FIG. 2 shows a cross sectional view of a nozzle pipe washing ejecting outlet o the sanitary washing device of the present invention.
Figure 3:
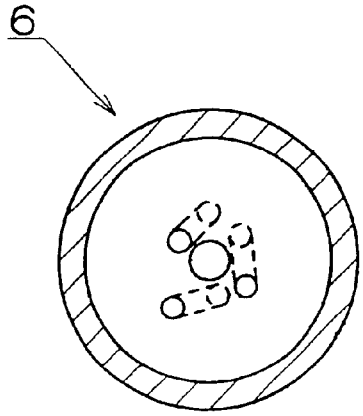
FIG. 3 shows a cross sectional view taken along the line III—III of Fig. 2.

The ejecting outlet for the nozzle pipe washer 6 sprays the warm water to the nozzle pipes 4 extending from the pair of cylinders 3. FIG. 2 shows a cross sectional view of the ejecting outlet for the nozzle pipe washer 6 as having two separated inner spaces 11, 12. In the inner wall separating the two separated inner spaces 11, 12, both straight bores and spiral bores are provided as shown in FIG. 3. This gives the flow of warm water in the inner space 12 a spiral component. Accordingly the warm water being discharged from the ejecting outlet 13 of the nozzle pipewasher 6 will have a wide cone-like pattern, as shown in FIG. 1, and the warm water will be sprayed widely over the nozzle pipes 4.

In the present embodiment of the sanitary washing device as described above, after the nozzle pipe 4 accommodated in the cylinder 3 is extended by the supply of the warm water through the changeover valve 2, the warm water is sprayed from the ejecting outlet provided on the end portion of the nozzle pipe 4 for washing the selected portion of the user sitting on the toilet bowl. Then, by the stopping of the warm water supply by using the changeover valve 2, the nozzle pipe 4 is retracted and is accommodated in the cylinder 3 again. At this time, that is during retraction of the nozzle pipe 4, by controlling the changeover valve 2, the warm water can be sprayed onto the nozzle pipe 4 from the ejecting outlet 13 for the nozzle pipe washer 6 during the movement of the nozzle pipe 4.

It is to be noted that in the present embodiment of the sanitary washing device, when the portion of the user is washed by the warm water sprayed from the ejecting outlet provided on the end portion of the nozzle pipe 4, human excrement attached to the portion of the user is spattered or the warm water drips from the portion of the user. However, the nozzle pipe 4 is subsequently cleaned automatically, since the warm water is sprayed onto the nozzle pipe 4 from the ejecting outlet 13 of the nozzle pipe washer during the retraction movement of the nozzle pipe 4.

If the changeover valve 2 is controlled to start the warm water supply to the ejecting outlet for the nozzle pipe washer 6 immediately after the warm water supply to the nozzle pipe 4 is stopped, and to stop the warm water supply to the ejecting outlet for the nozzle pipe washer 6 after a predetermined time period has passed after the warm water supply to the nozzle pipe 4 is stopped, the ejecting outlet of the nozzle pipe washer 6 sprays the warm water onto the nozzle pipe 4 as the nozzle pipe 4 is being retracted. In this case, after the event making the nozzle pipe 4 dirty has occurred, for example after the human excrement attached to the portion of the user is spattered or the warm water is dripped from the portion of the user, at least a minimum level of cleaning of the nozzle pipe 4 can be assured with little water usage, since the ejecting outlet for the nozzle pipe washer 6 sprays warm water onto the nozzle pipe 4.

In addition to the above mentioned control of the changeover valve 2, if the changeover valve 2 is controlled to start the warm water supply to the ejecting outlet for the nozzle pipe washer 6 immediately after the warm water supply to the nozzle pipe 4 is started, and to stop the warm water supply to the ejecting outlet for the nozzle pipe washer 6 after a predetermined period has been passed from the time that the warm water supply to the nozzle pipe 4 is started, the ejecting outlet for the nozzle pipe washer 6 sprays warm water onto the nozzle pipe 4 as the nozzle pipe 4 is being extended. In this case, since the nozzle pipe has been wetted by the spray from the ejecting outlet for the nozzle pipe washer 6 before the event making the nozzle pipe 4 dirty has occurred, for example before the human excrement attached to the portion of the user is spattered or the warm water is dripped from the portion of the user, the nozzle pipe 4 is not easily made dirty.

In addition to the above mentioned control of the changeover valve 2, if the changeover valve 2 is controlled to start the warm water supply to the ejecting outlet for the nozzle pipe washer 6 immediately after the warm water supply to the nozzle pipe 4 is started, and to stop the warm water supply to the ejecting outlet for the nozzle pipe washer 6 after a predetermined time period has passed after the warm water supply to the nozzle pipe 4 is stopped, the ejecting outlet for the nozzle pipe washer 6 sprays warm water onto the nozzle pipe 4 between the time when the nozzle pipe 4 starts extending from the cylinder 3 and the time when the nozzle pipe 4 is retracted and is accommodated in the cylinder 3. In this case, spraying occurs both before and after the event making the nozzle pipe 4 dirty has occurred, such as the human excrement attached to the portion of the user being spattered or the warm water being dripped from. the portion of the user. Therefore the nozzle pipe 4 will be made far less dirty since it is sprayed with warm water during the entire time of its extension.

Figure 4:
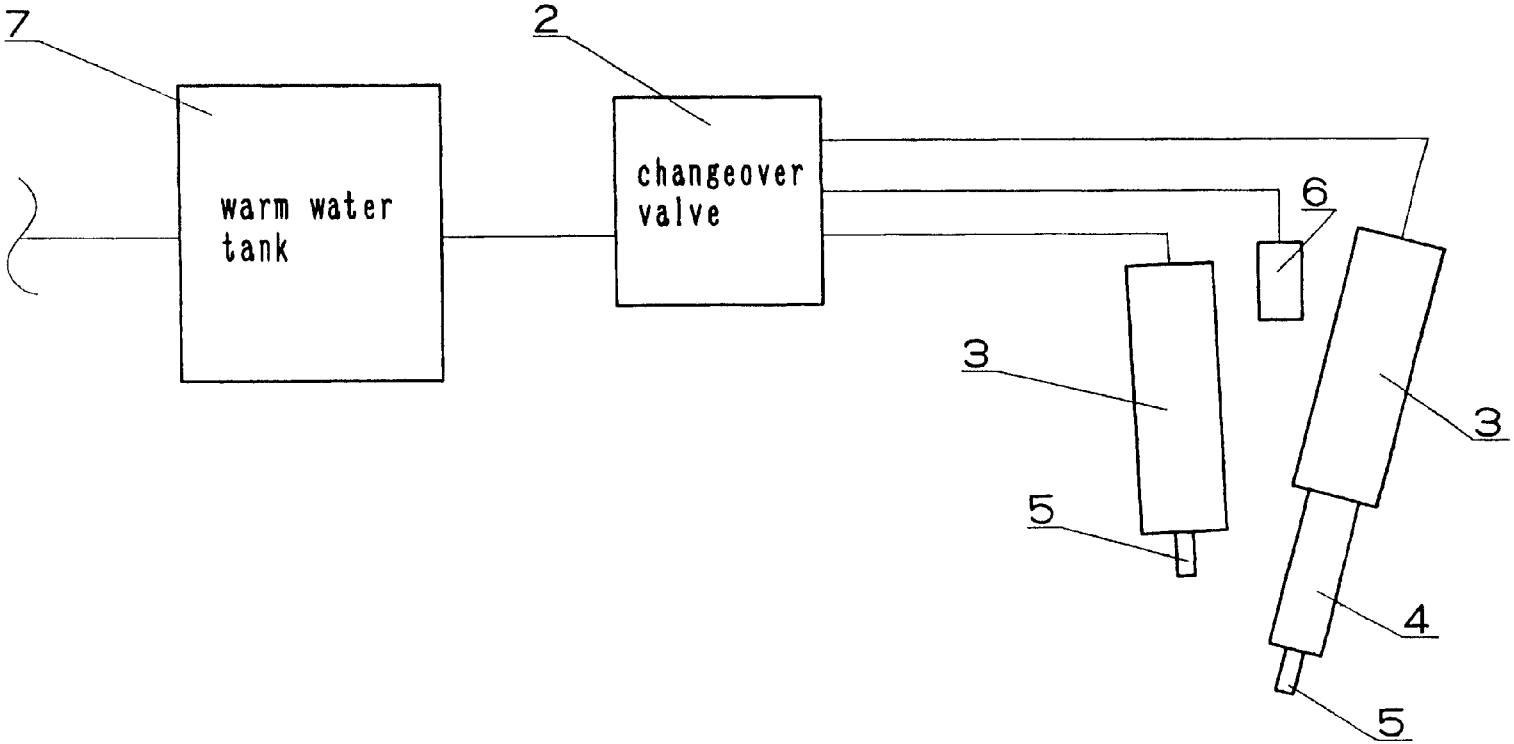
FIG. 4 shows a block diagram of a water system of the shower unit of the sanitary washing device of the present invention.

In the preferred embodiment of the sanitary washing device shown in FIG. 4, the washing water for washing the portion of the user, and the washing water for washing the nozzle pipe 4, are supplied by the warm tank 7 through the changeover valve 2. Since an existing washing water source can be used in the preferred embodiment of the sanitary washing device, the structure of an existing sanitary washing device does not need to be redesigned to a large degree.

The nozzle pipe 4 of the preferred sanitary washing device is extended and retracted by the warm water. A knob 5 may also be mounted on the end of the nozzle pipe 4 so that the nozzle pipe 4 can also be manually extended for manual cleaning. However, since the nozzle pipe 4 is cleaned automatically in the manner described above, such manual cleaning, which is likely to be unpleasant, need be done only rarely.

Further, the preferred embodiment of this invention is not limited to above mentioned types but several variations can be applied which do not deviate from the scope of the invention.

For example, the sanitary washing device of the preferred embodiment as shown in FIG. 1 is provided with a pair of the nozzle pipes 4, one nozzle pipe being exclusively used for anus washing and the other nozzle pipe being exclusively used for a bidet washing. But even if the sanitary washing device is provided with only one nozzle pipe 4, the nozzle pipe 4 can be cleaned automatically.

Further, in the sanitary washing device of the preferred embodiment, the nozzle pipes 4 are extended and retracted by the warm water. But even if the nozzle pipes 4 are extended and retracted by a motor, the nozzle pipes 4 can be cleaned automatically.

As another variant, while the ejecting outlet for the nozzle pipe washer sprays a cone-like pattern of warm water, the warm water can instead be sprayed in a curtain-like, or other, pattern.

As yet another variant, while the ejecting outlet for the nozzle pipe washer sprays warm water from the warm water tank 7 as a washing water for the nozzle pipe 4, tap water or compressed air can be substituted for the warm water from the warm water tank 7.

It is to be noted that in the present embodiment of the sanitary washing device, when the portion of the user is washed by the warm water sprayed from the ejecting outlet, human excrement attached to the portion of the user may be spattered or the warm water may drip from the portion of the user. However, the nozzle pipe is cleaned automatically since water is sprayed to the nozzle pipe by the nozzle pipe washer during movement of the nozzle pipe.

If the nozzle pipe washer sprays washing water onto the nozzle pipe while the nozzle pipe being retracted, after the event making the nozzle pipe dirty has occurred, such as after the human excrement attached to the portion of the user is spattered or the warm water is dripped from the portion of the user, a minimum cleaning function of the nozzle pipe can be assured, with the use of very little water.

In addition, if the nozzle pipe washer sprays washing water onto the nozzle pipe as the nozzle pipe is extended, and before the event making the nozzle pipe dirty has occurred, such as before the human excrement attached to the portion of the user is spattered or the warm water is dripped from the portion of the user, the nozzle pipe is not easily made dirty since the nozzle pipe has been wetted by the sprayed water.

In addition, if the nozzle pipe washer sprays washing water onto the nozzle pipe from the time when the nozzle pipe starts extending from the cylinder until the time when the nozzle pipe is again retracted and is accommodated in the cylinder, that is, both before and after the event making the nozzle pipe dirty has occurred, the nozzle pipe is made far less dirty since the nozzle pipe washer both wets and cleans the nozzle pipe.

When the washing water for the portion of the user, and the washing water for the nozzle, are supplied by the warm water tank through the changeover valve, since an existing washing water for the portion of the system can be used in carry out the preferred embodiment of the sanitary washing device, the structure of an existing sanitary washing device does not need to be redesigned to a large degree.

The nozzle pipe of the preferred sanitary washing device is extended and retracted by the warm water. The manual knob may also be used for manual cleaning. However, since the nozzle pipe is cleaned automatically in the manner described above, such manual cleaning, which is likely to be unpleasant, need be done only rarely.

What we claim is:

1. A sanitary washing device comprising:

a plurality of cylinders;

a nozzle pipe accommodated in each of the cylinders so as to be selectively extended from the respective cylinder in order to spray washing water from an ejecting outlet of the respective nozzle pipe;

a single nozzle pipe washer positioned to spray washing water onto plural nozzle pipes; and a control device configured and adapted to cause the nozzle pipe washer to spray washing water onto the nozzle pipes in accordance with a movement of the nozzle pipes.

2. The sanitary washing device as defined in claim 1, wherein the control device is configured and adapted to cause the nozzle pipe washer to spray washing water onto the nozzle pipe while the nozzle pipe is being retracted from an extended position.

3. The sanitary washing device as defined in claim 1, wherein the control device is configured and adapted to cause the nozzle pipe washer to spray washing water onto the nozzle pipe while the nozzle pipe is being extended to an extended position.

4. The sanitary washing device as defined in claim 1, wherein the control device is configured and adapted to cause the nozzle pipe washer to spray washing water onto the nozzle pipe from a time when the nozzle pipe begins to be extended from a retracted position to an extended position until a time when the nozzle pipe is returned from the extended position to the retracted position.

5. The sanitary washing device as, defined in claim 1, further comprising a warm water tank, wherein the control device includes a changeover valve adapted to selectively convey water from the warm water tank to at least one of the nozzle pipe and the nozzle pipe washer.

6. The sanitary washing device as defined in claim 1, wherein the nozzle pipe is configured and adapted to be extended by a supply of washing water.

7. A sanitary washing device adapted to be used in a toilet bowl for washing a portion of a user sitting on the toilet bowl, comprising:

a plurality of cylinders;

at least one nozzle pipe accommodated in each of the cylinders so as to be selectively extended from the respective cylinder in order to spray washing water from an ejecting outlet of the respective nozzle pipe onto the portion of the user sitting on the toilet bowl;

a single nozzle pipe washer positioned to spray washing water onto plural nozzle pipes; and a control device configured and adapted to cause the nozzle pipe washer to spray washing water onto the nozzle pipes in accordance with a movement of the nozzle pipes.

8. The sanitary washing device as defined in claim 7, wherein the control device is configured and adapted to cause the nozzle pipe washer to spray washing water onto the at least one nozzle pipe while the at least one nozzle pipe is being retracted from an extended position.

9. The sanitary washing device as defined in claim 7, wherein the control device is configured and adapted to cause the nozzle pipe washer to spray washing water onto the at least one nozzle pipe while the at least one nozzle pipe is being extended to an extended position.

10. The sanitary washing device as defined in claim 7, wherein the control device is configured and adapted to cause the nozzle pipe washer to spray washing water onto the at least one nozzle pipe from a time when the at least one nozzle pipe begins to be extended from a retracted position to an extended position until a time when the at least one nozzle pipe is returned from the extended position to the retracted position.

11. The sanitary washing device as, defined in claim 7, further comprising a warm water tank, wherein the control device includes a changeover valve adapted to selectively convey water from the warm water tank to at least one of the at least one nozzle pipe and the nozzle pipe washer.

12. The sanitary washing device as defined in claim 7, wherein the at least one nozzle pipe is configured and adapted to be extended by a supply of washing water.

13. A sanitary washing device in a toilet bowl for washing a portion of a user sitting on the toilet bowl, comprising:

nozzle pipe means selectively extendable from a cylinder for spraying washing water from an ejecting outlet of the nozzle pipe means onto the portion of the user sitting on the toilet bowl;

a single nozzle pipe washer means positioned to spray washing water onto plural nozzle pipes of said the nozzle pipe means; and control means for causing the single nozzle pipe washer means to spray washing water onto the plural nozzle pipes in accordance with a movement of the nozzle pipe means.

14. The sanitary washing device as defined in claim 13, wherein the control means causes the nozzle pipe washer means to spray washing water onto the nozzle pipe means while the nozzle pipe means is being retracted from an extended position.

15. The sanitary washing device as defined in claim 13, wherein the control means causes the nozzle pipe washer means to spray washing water onto the nozzle pipe means while the nozzle pipe means is being extended to an extended position.

16. The sanitary washing device as defined in claim 13, wherein the control means causes the nozzle pipe washer means to spray washing water onto the nozzle pipe means from a time when the nozzle pipe means begins to be extended from a retracted position to an extended position until a time when the nozzle pipe means is returned from the extended position to the retracted position.

17. The sanitary washing device as, defined in claim 13, further comprising a warm water tank, wherein the control means includes changeover valve means for selectively conveying water from the warm water tank to at least one of the nozzle pipe means and the nozzle pipe washer means.

18. The sanitary washing device as defined in claim 13, wherein the nozzle pipe means is configured and adapted to be extended by a supply of washing water.

* * * * *